United States Patent [19]

Meyer et al.

[11] Patent Number: 4,809,445

[45] Date of Patent: Mar. 7, 1989

[54] DEVICE FOR STABILIZING THE RUN OF A MATERIAL WEB, SPECIFICALLY FOR STABILIZING A PAPER WEB IN THE DRYING SECTION OF A PAPER MACHINE

[75] Inventors: Richard Meyer, Frickingen; Helmut Heinzmann, Böhmenkirch; Wolfgang Müller, Giengen, all of Fed. Rep. of Germany

[73] Assignee: J. M. Voith GmbH, Heidenheim, Fed. Rep. of Germany

[21] Appl. No.: 161,858

[22] Filed: Feb. 29, 1988

[30] Foreign Application Priority Data

Feb. 28, 1987 [DE] Fed. Rep. of Germany ..... 3706541

[51] Int. Cl.[4] ..... F26B 11/02

[52] U.S. Cl. ..... 34/117; 34/120; 34/123

[58] Field of Search ..... 34/108, 110, 111, 113, 34/114, 116, 117, 120, 122, 123, 155, 156

[56] References Cited

U.S. PATENT DOCUMENTS

| | | | |
|---|---|---|---|
| 3,587,177 | 6/1971 | Overly | 34/156 |
| 4,441,263 | 4/1984 | Vedenpaa | 34/115 |
| 4,502,231 | 3/1985 | Fissmann et al. | 34/114 |
| 4,551,203 | 11/1985 | Eskelinen | 34/114 X |
| 4,628,618 | 12/1986 | Virta et al. | 34/116 |
| 4,669,196 | 6/1987 | Wedel | 34/116 X |
| 4,686,777 | 8/1987 | Cooke | 34/116 |
| 4,698,919 | 1/1987 | Wedel | 34/117 |

*Primary Examiner*—Steven E. Warner

*Attorney, Agent, or Firm*—Albert L. Jeffers; Richard L. Robinson

[57] ABSTRACT

In a device for stabilizing the run of a material web, which successively runs over two rolls, namely a delivering and a receiving roll, there is a box provided that extends between the delivering and the receiving roll across the width of the paper web. This box has a so-called guide wall that extends along the course of the material web, with an air gap remaining between the guide wall and the material web. Additionally provided on the box are means which create a vacuum in the air gap. In a device of this type, the guide wall is shaped in a way such that its spacing from the theoretical trajectory plane tangent to the two rolls is in the center area of the material web greater than it is in the araa of the material web edges. A device of this type serves to better stabilize the smooth running of the material web on its way between the rolls. A preferred applicational area of the invention is an air guide box (20) for the drying section of a high-speed paper machine where the paper web (16) to be dried meanders together with a backing belt (18) over drying cylinders (10–14).

11 Claims, 1 Drawing Sheet

DEVICE FOR STABILIZING THE RUN OF A MATERIAL WEB, SPECIFICALLY FOR STABILIZING A PAPER WEB IN THE DRYING SECTION OF A PAPER MACHINE

BACKGROUND OF THE INVENTION

The present invention concerns a device for stabilizing the run of a material web which successively runs over two rolls, namely a "first or delivering" roll and a "second or receiving" roll, specifically for application in the drying section of a high speed paper machine where the paper web to be dried meanders over drying cylinders. Devices of this type have various applications, and at that, specifically in conjunction with high-speed paper machines A preferred application for a device of the categorial type is an air guide box arranged between a delivering and a receiving drying cylinder, for the drying section of a paper machine, (a so-called web stabilizer).

However, a device of the above type is usable also as a run stabilizer for a backing belt section running upward, that is, on the second side of the paper web (on the side from the lower to the upper drying cylinder), as compared with the above preferred application.

The above device is usable also in connection with a so-called "transfer foil", i.e., a device for transferring the paper web from the press section to the drying section (compare U.S. Pat. No. 4,551,203).

Outside the actual paper-making machine, a device for stabilizing the run of a web, for instance a paper web, is usable, e.g., on paper coaters. In this case, a run stabilizer may be arranged on a backing belt section which together with the paper web runs from a reversing cylinder to a guide roll where the paper web and the backing belt separate.

A run stabilizer of the above type can be used also for supporting a paper web by itself, i.e., a paper web without a backing belt. Pertinent applications are, e.g., drying sections of paper machines with two backing belts (so-called double screen arrangements with upper and lower felt) or the unwinder of a paper coater.

Outside the paper industry, devices of the categorial type of the invention can be used also for the treatment of fabric webs, i.e., for the noncontact cleaning and drying, by means of so-called air foil nozzles according to, e.g., the U.S. Pat. No. 3,587,177.

Considering the many applications of devices of the categorial type, the problem underlying the invention is to so conceive these devices that the material web will be optimally stabilized as regards its smooth run, while traveling between the rolls.

This problem is solved by the features of the present invention. Further developments of the present invention include, among others, an air stripper (mechanical stripper or air scraper) arranged on the guide wall edge on the approach side, which is shaped analogous to the guide wall as viewed across the material web.

Additionally, the invention is described and discussed below on the basis of its preferred applicational area, i.e., in its use as an air guide box for the drying section of a high-speed paper machine.

An air guide box of this type is known from the German patent document No. 32 36 576 which is equivalent to U.S. Pat. No. 4,502,231. This air guide box has extensively met the requirements imposed on it, namely holding the paper web safely on the backing belt up to the inlet gore; it has proved itself well and has been used with great success.

The application-specific problem underlying the present invention consists in modifying the design of the known air guide box in such a way that the stability of the trajectory of backing belt and paper web will be improved further across the width of the drying section. This problem is solved by the present invention.

Underlying the present invention is the insight that the paper web running between the functionally corresponding drying cylinders or rolls can be supported and stabilized by the backing belt better yet than is possible with the known air guide boxes. This is accomplished in that the wall of the air guide box situated opposite the paper web respectively the backing belt, forming the so-called foil wall, is shaped, viewed across the width of the drying section, according to the curved trajectory that occurs in the operation.

Known from U.S. Pat. No. 4,441,263 is a device for the drying section of a paper machine where a sideways marginal zone is separated for a specific influencing, i.e., carrying the leader which is the start-up of the paper machine is to be threaded into the drying section. But this measure serves exclusively the safe pick-up of said leader. The measure, i.e., the separate edge chamber, has specifically no influence on the overall width of the material web consisting of paper web and backing belt passing through the drying section.

As compared to U.S. Pat. No. 4,441,263, the objective of the present invention is to favorably influence the pressure conditions in the area where the paper web runs together with the backing belt on the receiving drying cylinder, across the entire width of the paper web (that is, across the entire length of the drying cylinder).

As is generally known, air flow transverse to the drying section causes the edges of the paper web to flutter and/or the formation of wrinkles in the paper web. This also frequently involves the risk that the paper web may break, thus interrupting the production. Thus, the objective is reducing the production-limiting risks caused by excessively strong air flows and/or speed-dependent forces.

The concept of the web stabilizer known in conjunction with paper machines is based on the fact that a vacuum is created in the gap between backing belt and foil wall, thereby sucking the paper web on the backing belt.

According to the present invention, this concept is developed further, and at that, through the following insights and the resulting measures: A stable, smooth run of the paper web requires, for one, that the forces resulting from the longitudinal tension of the paper web respectively of the backing belt running with the paper web and, for another, the forces resulting from said vacuum are at equilibrium with each other. This longitudinal tension of the backing belt, as generally known, is adjusted with the aid of a tensioning roll over which the backing belt runs. The longitudinal tension tends to hold the backing belt in a theoretical tangential plane to both cylinders. The forces resulting from the vacuum, facultatively supported by other, for instance dynamic forces, however, cause a curvature of the actual trajectory of the backing belt with the paper web, toward the web stabilizer.

It has been found that this curvature is irregular, and at that, irregular when viewed across the width of the paper web. In the center, the paper web with the backing belt bows out more heavily than on the edges. In other words: A spacing between the paper web and the foil wall of the web stabilizer that is smaller than in the marginal areas occurs in the center of the paper web. This phenomenon is the stronger the greater the space between the two drying cylinders and the wider the paper web.

It goes without saying that the web stabilizer needs to be so installed that the risk of a contact between the center, most heavily bowed out area of the backing belt and the foil wall of the web stabilizer will be avoided. But this involves the risk that the edges of the backing belt and of the paper web will be so far removed from the foil wall that at these points an only insufficient vacuum will build up. Consequently, the paper web would, in exactly the most critical marginal zones, not be sucked sufficiently onto the backing belt.

According to the present invention, this risk is to be precluded, and this is achieved in that the foil wall, viewed in a longitudinal section through the web stabilizer, extends no longer in a straight line as heretofore, i.e., entirely flat, but is designed with a curvature according to the variously heavy bow-out of backing belt and paper web.

Achieved thereby is keeping the clearance of the gap between the backing belt and the foil wall of the web stabilizer across the width of the paper machine (i.e., across the length of the web stabilizer) considerably more uniform than heretofore. Thus, specifically also in the marginal areas of the paper web. a relatively small gap width can be adjusted, improving exactly there the effect of the web stabilizer; the edges of the paper web are thus held on the backing belt with a greater safety than heretofore and prevented from fluttering.

The invention acts—in accordance with the initially mentioned application—analogously in the same way when the web stabilizer serves to control a single-layer material web, for instance a paper web running without support by a backing belt successively over two cylinders. In this case, too, avoiding flutter of the paper web edges is managed better than before.

In view of the present discussion and distinction from U.S. Pat. No. 4,441,263, it is more generally pointed out again that the application of the invention is not limited to paper machines with so-called contact screen support and not to paper machines as such either. In this sense, the present discussion also permits a much more general reading when replacing the term "paper web" respectively "backing belt" by "material web" and the term "drying cylinder" by "roll".

BRIEF DESCRIPTION OF THE DRAWINGS

The invention will be more fully explained with the aid of the drawing.

DESCRIPTION OF THE PREFERRED EMBODIMENTS

Figure 1:
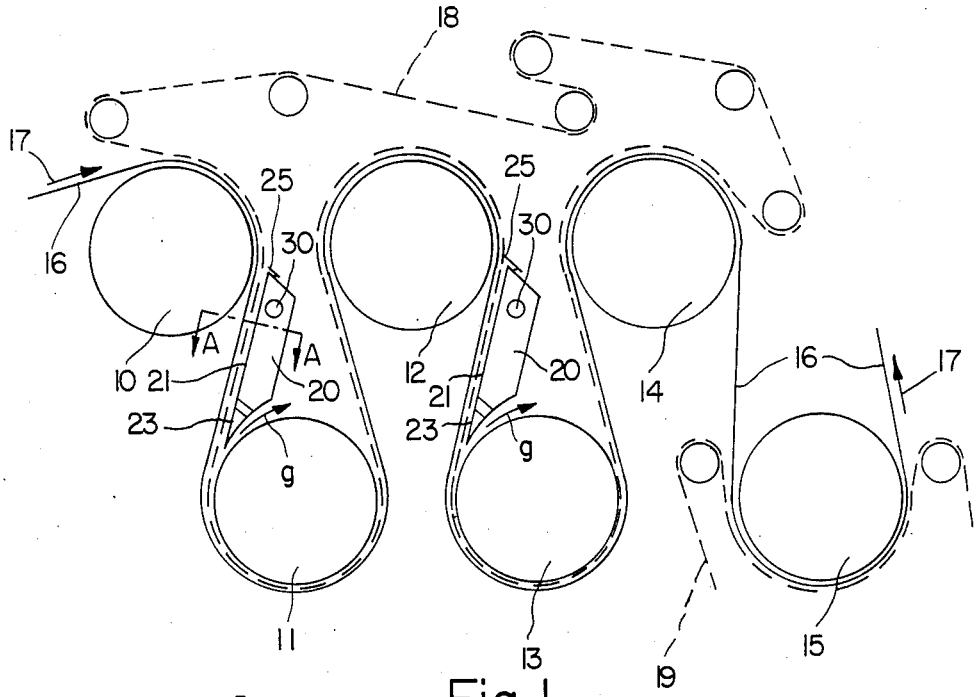
FIG. 1 shows schematically a section of a drying section of a paper machine.

The five drying cylinders 10 hhrough 14 illustrated in FIG. 1 form a drying group of a drying section. Another drying cylinder, marked 15, is an integral part of a following drying section. The drying cylinders 10, 12 and 14 are arranged in a top row, the cylinders 11, 12 and 15 in a bottom row. The paper web 16 to be dried meanders in the direction of arrows 17 across the drying cylinders. In the process, within the first drying group 10 through 14, it is constantly accompanied by a continuous air-permeable backing belt 18. The drying cylinders 10, 12 and 14 of the upper row are situated outside the loop formed by the backing belt 18; the cylinders 11 and 13 of the bottom row are located within the loop. Thus, the paper web 16 extends in the area of the upper cylinders 10, 12 and 14 between their cylinder surfaces and the backing belt 18. In the area of the bottom cylinders 11 and 13, conversely, the paper web 16 is located on the outside of the backing belt which is in contact with these cylinders. In the free sections between the cylinders 12 through 14, the paper web is supported by the backing belt 18. A free paper train occurs for the first time between the cylinders 14 and 15. In the following drying groups, each cylinder row has a backing belt 19 of its own.

Provided on the common path of the paper web 16 and backing belt 18 from one of the upper drying cylinders 10 respectively 12 to one of the lower cylinders 11 respectively 13, on the side of the backing belt, is an air guide box 20 each. Rigid and having a length equal to the web width or less, each of these air guide boxes 20 extends across the drying section. Shorter air guide boxes are preferably arranged in the marginal areas of the paper web. Such an air guide box 20 will be more fully described hereafter.

Essentially closed all around, the air guide box 20 has a first wall 21, hereafter called foil wall, which—viewed in cross-section of the air guide box 20—extends along the backing belt 18 up into the inlet gore 22 formed by the backing belt and the free cylinder surface of the lower drying cylinder 11 respectively 13. This leaves between the foil wall 21 and the backing belt 18 a gap 23 which according to the design relative to German patent document No. 32 36 576 diverges toward the inlet gore. Unlike in the air guide boxes 20 described so far and known from the German patent document 32 36 576, the first wall 21, viewed across the width of the drying section, is designed correspondingly with regard to the gap 23 of the real material web.

Figure 2A:
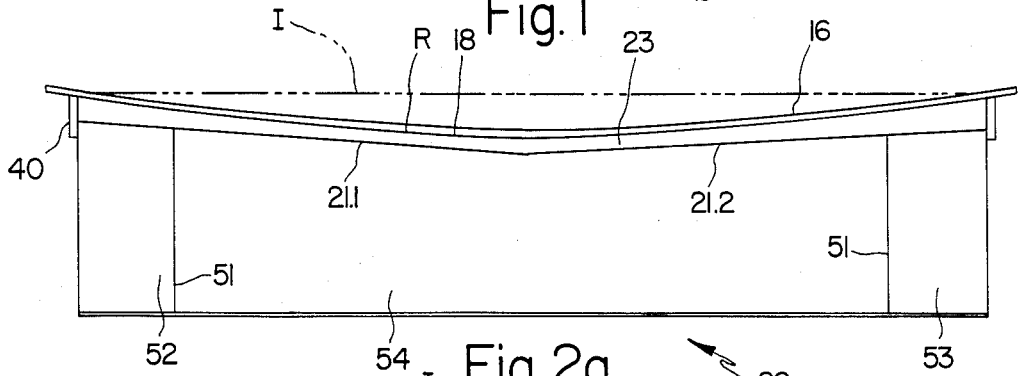
FIG. 2*a* shows an inventionally designed air guide box, viewed in the running direction of paper web/-backing belt, and at that, in longitudinal section A—A according to FIG. 1 and perpendicular to the drawing plane of FIG. 1.
Figure 2B:
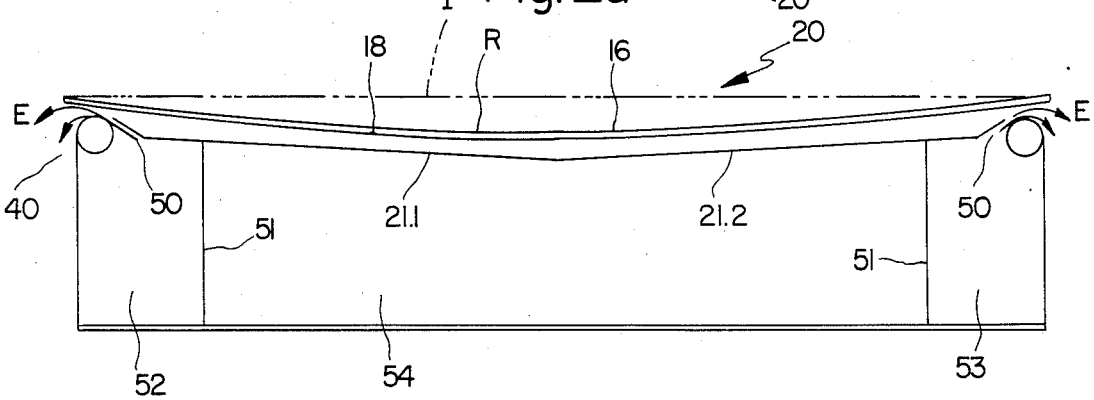
FIG. 2*b* shows another embodiment of an inventionally designed air guide box, viewed in the running direction of paper web/backing belt, and at that, in longitudinal section A—A according to FIG. 1 and perpendicular to the drawing plane of FIG. 1.

This air guide box 20 is more full explained with the aid of FIGS. 2*a* and 2*b*. According to FIGS. 2*a* and 2*b*, the paper web 16 and the backing belt 18 run onto the bottom drying cylinder. Assuming a lower speed and appropriate paper web/backing belt tension, the paper web 16 and the backing belt 18 would be delivered and taken up following the ideal material trajectory I. Due to, e.g., centrifugal forces, this material trajectory bows out, however, in the center area of the air guide box 20, creating an arcuate material trajectory R transverse to the foil wall 21 of the air guide box 20. This real material trajectory R, in the final analysis, corresponds with the shape of the paper web 16 and backing belt 18 on their way from the delivering cylinder to the receiving cylinder, and the foil wall 21 of the air guide box 20 is approximately adapted to this trajectory R, and at that, with the proviso that the gap 23, starting from the two ends of the air guide box 20, increases toward the center, that is, the spacing between the foil wall 21 of the air guide box 20 and the ideal material trajectory I, viewed across the width of the foil wall 21, becomes greater from the outside to the inside.

According to the illustration relative to FIG. *2a* respectively *2b*, the gap 23 is realized by a polygonal design of the first wall. The foil wall 21 of the air guide box 20 consists of two partial walls 21.1, 21.2 meeting at an obtuse angle. But it is definitely within the scope of the present invention to adapt the foil wall 21 from more than two partial walls more closely to the real material trajectory R.

Viewed across the entire width of the foil wall 21, a vacuum is created due to this gap 23, which vacuum favors in the final analysis the adhesion between the paper web 16 and the air-permeable backing belt 18 (foil effect). The vacuum profile is thus adapted to local conditions and requirements, transverse to the drying section.

The air guide box 20 as a whole, additionally, is conceived as follows. It is known that so-called leakage flows entering the air guide box 20 on its ends, i.e., air proceeding sideways into the gap 23, has an influence on the vacuum conditions in said gap, and at that, to the effect of reducing the vacuum. This, in a further development of the present invention, is compensated for in that the air guide box 20 is defined on both ends by end walls 40 which serve to protect the gap 23 from leakage air entering on its ends.

In the embodiment according to FIG. *2a*, these end walls 40 are formed each by a felt strip fixed sideways on the air guide box 20 and so arranged that the spacing between the free front edge of the felt strip and the material trajectory R is minimal. The felt strip offers the advantage that the backing belt will not be damaged even when, as the case may be, a contact comes about.

In the embodiment according to FIG. *2b*, the end walls 40 are formed each by an ejector device. In this case, the leakage flows at the edges of the material trajectory R are prevented by oppositely directed air jets E. These air jets E discharge from nozzles 50 which are freely spaced from the material web and flow toward the entering leakage air.

Both versions of the end wall respectively ejector device are previously known from FIGS. 4 and 5 of U.S. Pat. No. 4,628,618.

The vacuum space created by the gap 23 between the air guide box 20 and the material web R is thus limited sideways. The vacuum profile created in the area of the first wall 21 of the air guide box 20 remains thus extensively uninfluenced by leakage currents.

The air guide boxes 20 illustrated in FIGS. *2a* and *2b* feature additionally, in the marginal areas on both sides, marginal chambers 52, 53 defined by bulkheads 51. Generated in these marginal chambers, by means of suitable air control and choking means, can be an elevated pressure relative to the main chambers 54 situated in between, which pressure serves the improved support of the marginal areas of the material web R. The blowing air supply for the separate chambers of the air guide box 20 can be handled by means of a central blower and suitable dampers or by means of separate blowers. A blower connection is indicated in FIG. 1 at 30.

According to the German patent document No. 32 36 576, a blowing slot may be provided in the box wall opposite the lower cylinder 11, 13 creating an air flow illustrated by arrow 9. This air flow enhances the vacuum generated by the foil wall 21 in the gap 23.

Regarding the design respectively dimensioning of the air guide boxes, the following should be pointed out. The purpose of these air guide boxes is to stabilize the smooth run of the paper web respectively backing belt on their way from the delivering to the receiving drying cylinder. Insofar, also the length of the air guide box, that is, the height of the foil wall, plays a major role.

Taught by the German patent document No. 32 36 576 are air guide boxes whose foil wall extends approximately across two thirds of the height of the tangential surface between the delivering (upper) and receiving (lower) drying cylinder, where from the upper departure point to the edge of the air guide box on the approach end there is a space provided of approximately one third of said tangential surface.

In the same-priority patent application (assignee: J. M. Voith GmbH, Heidenheim; internal file: P No. 4365; code word: Polygon-BST; title: Air Guide Box for the Drying Section of a High-Speed Paper Machine) and also in the illustration according to FIG. 1 of the present application there are shown air guide boxes whose foil wall extends up to the (upper) departure point on the delivering (upper) drying cylinder and even beyond.

The inventional air guide box is suited for both designs equally.

In view of the above air guide boxes, the following should be pointed out yet. A so-called boundary layer stripper 25 (FIG. 1) is provided on the approach side edge of the air guide boxes respectively the foil wall. These boundary layer strippers 25, which may be fashioned as mechanical strippers in the form of felt strips or a plastic brush or as an air scraper are shaped analogous to the curvature respectively polygonal design of the approach side edge of the foil wall (i.e., analogous to the design according to FIGS. *2a* and *2b*).

What is claimed is:

1. Device for stabilizing the run of a material web which successively runs over two rolls, namely a first delivering roll and a second receiving roll, characterized by:

said device comprising a box that extends between the first and the second roll across the width of the material web;

said box having a guide wall which, viewed in cross-section, extends along the trajectory of the material web leaving an air gap between the guide wall and the material web;

means provided on the box for forming a vacuum in said air gap; and the guide wall being so shaped that the spacing thereof from a theoretical trajectory tangent to the two rolls is greater in the center area of the material web than in the marginal area of the edges of the material web.

2. Device according to claim 1, in which the guide wall is composed of several flat partial walls.

3. Device according to claim 1, including a device arranged on an approach side edge of the guide wall for stripping the air boundary layer carried along by the material web, the stripping device extending across the entire length of the box crosswise over the width of the material web, the stripping device being curved analogous to the guide wall.

4. Device according to claim 1 for use as an air guide box for a drying section of a high-speed paper machine where a paper web to be dried meanders together with a backing belt over drying cylinders wherein:

the air box extends crosswise through the drying section between two successive drying cylinders and along the backing belt up to an inlet gore between said belt and a lower drying cylinder receiving the paper web and the backing belt;

the air guide box includes a first foil wall which, viewed in cross-section of the box, extends along the backing belt with a gap remaining between the first wall and the backing belt;

the air guide box connected to a blowing air supply;

the foil wall, across the width of the lower drying cylinder, is configured polygonally such that, with respect to the theoretical trajectory tangent to two successive drying cylinders, the gap is greater in the centeraarea than it is in the marginal area.

5. Air guide box according to claim 4, in which the foil wall includes two partial walls meeting at an obtuse angle, the angle having a value selected in accordance with the bow-out of the paper web and the backing belt that occurs in the operation of the paper machine in the center area.

6. Air guide box according to claim 4 including end walls formed each by a sealing lip that defines the gap sideways.

7. Air guide box according to claim 4, including end walls formed each by a lateral ejector device.

8. Air guide box according to claim 7, in which the ejector device includes a nozzle gap through which blowing air is blown at the edge of the backing belt with the paper web.

9. Air guide box according to claim 4, in which bulkheads subdivide an air space within the air guide box into a center main chamber and two marginal chambers on the ends.

10. Air guide box according to claim 9, in which the center main chamber and the marginal chambers are connected to separate blowing air supplies.

11. Air guide box according to claim 9, in which the center main chamber and the marginal chambers are connected to a central blowing air supply, and means are provided by way of which specific pressure values are adjustable in the various chambers.

* * * * *

UNITED STATES PATENT AND TRADEMARK OFFICE

CERTIFICATE OF CORRECTION

PATENT NO. : 4,809,445

DATED : March 7, 1989

INVENTOR(S) : Richard Meyer et al

It is certified that error appears in the above-identified patent and that said Letters Patent is hereby corrected as shown below:

In the Abstract, line 13, change "araa" to --area--;
Col. 4, line 4, change "hhrough" to --through--;
Claim 4, Col. 7, line 19, change "centeraarea" to --center area--.

Signed and Sealed this

Nineteenth Day of September, 1989

*Attest:*

*Attesting Officer*

DONALD J. QUIGG

*Commissioner of Patents and Trademarks*